United States Patent [19]

Yamamoto et al.

[11] Patent Number: 4,483,976

[45] Date of Patent: Nov. 20, 1984

[54] POLYESTER BINDER FIBERS

[75] Inventors: Tamio Yamamoto; Hiroshi Tamaya, both of Matsuyama, Japan

[73] Assignee: Teijin Limited, Osaka, Japan

[21] Appl. No.: 524,000

[22] Filed: Aug. 17, 1983

[30] Foreign Application Priority Data

Feb. 1, 1983 [JP] Japan ..... 58-13743

[51] Int. Cl.[3] ..... C08G 63/68

[52] U.S. Cl. ..... 528/295; 528/275; 528/301

[58] Field of Search ..... 528/275, 295, 301

[56] References Cited

U.S. PATENT DOCUMENTS 3,185,671 5/1965 Horn ..... 528/275 X
3,528,947 9/1970 Lappin et al. ..... 528/295
3,936,389 2/1976 King et al. ..... 528/295 X
4,104,262 8/1978 Schade ..... 528/295
4,390,687 6/1983 Tung ..... 528/295

*Primary Examiner*—Lucille M. Phynes
*Attorney, Agent, or Firm*—Sughrue, Mion, Zinn, Macpeak and Seas

[57] ABSTRACT

Polyester binder fibers consisting of a water-dispersible copolymerized polyester, comprising at least one dicarboxylic acid and/or an esterforming derivative thereof, a glycol and an esterforming sulfonic acid alkali metal salt composition, wherein the total glycol component contained in the above mentioned polyester contains from 5 mole percent to 20 mole percent of a composition represented by the formula $H—(OCH_2CH_2)_n—OH$, wherein n is an integer of from 2 to 13. The binder fibers are useful especially in a papermaking process.

4 Claims, No Drawings

POLYESTER BINDER FIBERS

FIELD OF THE INVENTION

The present invention relates to adhesive materials for fibrous structures of fibers such as non-woven fabrics and, more particularly, to binder fibers of copolymerized polyesters for use as papermaking adhesive materials.

DESCRIPTION OF THE PRIOR ART

In the field of non-woven fabrics of late, a variety of fibrous binders are being developed and are being introduced into the market at an increasing tempo in substitution for the conventional emulsion type binders for energy saving and contamination preventive purposes. Examples of such fibrous binders include sheath-core type conjugate polyolefin fibers consisting of sheath components of polyethylene or copolymerized polypropylene and core components of polypropylene, and polyvinyl alcohol fibers which are to melt at 60° to 80° C. in water. Commercially available as the former type of fibrous binders are, for example, the "ES" (R.T.M.) fibers and "EA" (R.T.M.) fibers both manufactured by Chisso Corporation, Osaka, Japan and as the latter type of fibrous binders are, for example, the VPB series of "Kuraray Vinylon" (R.T.M.) manufactured by Kuraray & Co., Ltd., Osaka, Japan.

The former type of fibrous binders, viz., sheath-core type conjugate polyolefin fibers take effect when used for the binding of fibrous structures containing polyolefin fibers as the principal fiber components. When used for other chemical synthetic fibers such as rayon, polyester and nylon fibers, these binder fibers exhibit scarce effect as a binder and thus must be used in such a quantity that the binder fibers account for more than 30 percent of the total quantity. This results in deterioration of some properties such as the tenacity and hand or feeling of the principal fiber components. The latter type of fibrous binders, viz., polyvinyl alcohol fibers are allowed to melt only in the presence of water and are in most cases used as binders in papermaking processes. These fibers take considerable effect as the binders when used for the binding of the fibrous structures of fibers containing vinylon, rayon or pulp as the principal components but are far less effective when used for the fibrous structures of fibers containing nylon, polyester or acrylic fibers. For the binding of such fibrous structures, polyvinyl alcohol fibers must therefore be used in large proportions to the structures this also causing deterioration in the hand of the principal fiber components.

On the other hand, it is known to use a water-dispersible polyester as the sizing agent for binding together the multifilaments of the yarns to be transferred to a weaving stage during the manufacture of textile materials. A known example of such a sizing agent is taught in U.S. Pat. No. 3,546,008. The sizing agent disclosed therein comprises a polyester copolymerized with a glycol containing more than 20 mole percent of diethylene glycol and a difunctional sulfonic acid metal salt composition with two esterforming groups. Another known example of the sizing agent using a water-disipersible polyester is taught in Japanese Provisional Patent Publication No. 50-121,336 and comprises a polyester copolymerized with a glycol containing 20 to 80 percent by weight of diethylene glycol and a difunctional sulfonic acid metal salt with two esterforming groups.

The diethylene and polyethylene glycol components in these prior-art sizing compositions are copolymerized in so great proportions that drawbacks are involved in that the resistances of the compositions to heat and weather tend to be deteriorated. In the case of the latter sizing composition, there is a further drawback that the intrinsic viscosity of the composition is deficient to provide an acceptable degree of softness. Furthermore, difficulties are encountered in processing the water-dispersible polyesters into fibers and for this reason it has not been known to utilize the polyesters as the materials for preparing binder fibers.

SUMMARY OF THE INVENTION

It is, accordingly, an object of the present invention to provide solutions to the above described drawbacks by making it possible to process a specified water-dispersible polyester into the form of fibers.

It is another object of the present invention to provide binder fibers consisting of a novel copolymerized polyester which will find a wide variety of practical applications and which need not be used in a large percentage for each application.

In accordance with the present invention, there are provided polyester binder fibers consisting of a copolymerized polyester comprising at least one dicarboxylic acid and/or an esterforming derivative thereof, a glycol and an esterforming sulfonic acid alkali metal salt composition, wherein the total glycol component contained in said polyester contains from 5 mole percent to 20 mole percent of a composition represented by the formula $H—OCH_2CH_2)_nOH$, wherein n is an integer of from 2 to 13.

DESCRIPTION OF THE PREFERRED EMBODIMENTS

The dicarboxylic acid component or components used in the present invention may be of the aliphatic, alicyclic or aromatic group. Examples such a dicarboxylic acid include oxalic acid, malonic acid, dimethyl malonic acid, succinic acid, glutaric acid, adipic acid, trimethyl adipic acid, pimelic acid, 2,2-dimethyl glutaric acid, azelaic acid, 1,3-cyclopentane dicarboxylic acid, 1,2-cyclohexane dicarboxylic acid, 1,3-cyclohexane dicarboxylic acid, 1,4-cyclohexane dicarboxylic acid, terephthalic acid, isophthalic acid, phthalic acid, 2,5-dimethyl terephthalic acid, 1,4-naphthalene dicarboxylic acid, 2,5-naphthalene dicarboxylic acid, biphenyl dicarboxylic acid, diphenic acid, diglycol acid, thiodipropionic acid, and esterforming derivatives of these. Copolymers may be prepared from two or more of these carboxylic acids or any derivatives thereof. Preferred among the compositions above mentioned are aromatic dicarboxylic acids, particularly, the terephthalic acid.

Operable as the glycol component used in the present invention is ethylene glycol, 1,2-propanediol, 1,3-propanediol, 1,4-butanediol, 2,4-dimethyl-2-ethylhexane-1,3-diol, neopenthyl glycol, 2-ethyl-2-butyl-1,3-propanediol, 1,6-hexanediol, 1,8-octanediol, 1,10-decanediol, 2,2,4-trimethyl-1,6-hexanediol, 1,2-cyclohexanediol, 1,2-cyclohexane dimethanol, 1,3-cyclohexane dimethanol, 1,4-cyclohexane dimethanol, 2,2,4,4-tetramethyl-1,3-cyclobutanediol, or p-xylyleneglycol. Copolymers may be prepared from two or more of these glycols. Preferred among the compositions above mentioned are ethylene glycol, 1,3-propanediol, 1,4-butanediol, and 1,4-cyclohexane dimethanol.

On the other hand, examples of the esterforming sulfonic acid alkali metal salt composition include alkali metal salts of sulfoterephthalic acid, 5-sulfoisophthalic acid, 4-sulfophthalic acid, 4-sulfonaphthalene-2,7-dicarboxylic acid, sulfop-xylylene glycol and sulfo-1,4-bis(-hydroxyethoxy)benzene or any esterforming derivatives of such alkali metal salts. While there is no limitation as to the proportion of the alkali salt composition to be contained in the final product, it is preferable that the composition be used in a quantity which is more than 3 mole percent to the dicarboxylic component. The particularly preferred esterforming sulfonic acid alkali metal salt composition is 5-sodiosulfoisophthalate.

The polyoxyethylene glycol contained in the glycol component of the polyester composition provided by the present invention is represented by the formula $H—OCH_2CH_2)_nOH$ wherein n is an integer of from 2 to 13. Examples of such a composition include dioxyethylene glycol, trioxyethylene glycol, tetraoxyethylene glycol and pentaoxyethylene glycol. To facilitate production of filaments by a melt spinning process, to hinder adhesion of fibers together for thereby providing ease of handling, and to achieve an excellent resistance to heat, it is preferable that the number n in the formula $H—OCH_2CH_2)_nOH$ be an integer of from 2 to 5 or more preferably from 2 or 3.

The proportion in quantity of the polyoxyethylene glycol thus represented by the formula $H—OCH_2CH_2)_nOH$ to the total glycol component of the polyester composition is 5 mole percent to 20 mole percent to the glycol component. If the glycol component contains less than 5 mole percent of polyoxyethylene glycol, the resultant final product would have insufficient adhesiveness and would thus fail to serve as an operable binder. If, conversely, more than 20 mole percent of polyoxyethylene glycol is contained in the glycol component, the fibers forming the final product would become excessively adhesive to one another and would thus cause inconvenience for handling and impair the resistance of the material to heat.

In order to achieve a satisfactory degree of adhesiveness, it is preferable that the copolymerized polyester composition forming the binder fibers according to the present invention have a birefringence of less than 0.10 or, more preferably, than 0.08.

The copolymerized polyester composition to form the binder fibers according to the present invention is prepared by a polymerization process using an ester interchange reaction, a direct polymerization process or any of other ordinary processes without modifying the process.

In one of such a process, predetermined amounts of dicarboxylic acid alkylester, glycol and sulfonic acid alkali metal salt dialkylester are heated in the presence of an ester interchange catalyst. The alkyl alcohol produced is removed from the reaction product as the ester interchange reaction proceeds. A polymerization catalyst, a chemical stabilizer and a predetermined amount of polyoxyethylene glycol were added to the resultant product, whereupon ethylene glycol is removed at a high temperature in a vacuum. In another process, dicarboxylic acid, glycol and an esterforming sulfonic acid alkali metal salt composition are heated without any catalyst or in the presence of an esterification catalyst. The water produced is removed from the reaction product at an atmospheric pressure or under applied pressure as the esterification proceeds. Polyoxyethylene glycol is then added to the resultant product to effect polycondensation.

In each of these processes, the esterforming sulfonic acid alkali metal salt composition and the polyoxyethylene glycol are added together preferably before the ester interchange or the esterification takes place but may be added together upon completion of the ester interchange or the esterification. Furthermore, these materials may be added together in the forms of glycol solutions, flakes or powder.

The copolymerized polyester prepared in the above described manner may be rendered into the form of filaments by a melt spinning process, a wet spinning process, a dry spinning process or any other similar process. The most preferred of these is, however, the melt spinning process for its ease of operation, energy saving feature and relatively high production efficiency and further because of the freedom from the necessity of recovering solvents at the end of the process. For carrying out the melt spinning process in a stable condition, it is preferable that the polyester composition be prepared in such a manner as to have an intrinsic viscosity of more than 0.25.

The polyester filaments thus produced may cut to a predetermined length without being subjected to drawing and thermal treatment or may be drawn and thereafter cut to a predetermined length without being thermally processed. The fineness and the length of each of the binder fibers produced in this fashion may be selected arbitrarily but are preferably of the orders of from 0.5 to 15 in denier and from 1 to 20 millimeters, respectively, where the binder fibers are to be used for papermaking purposes.

The polyester binder fibers obtained as above described is particularly useful as a binder for use in a papermaking process since the fibers show an ease of swelling or dispersion in water and is readily dispersed in relatively hot water. In this connection it may be noted that the binder fibers provided by the present invention exhibit surprising effectiveness for the binding of not only polyester-based fibrous structures but also structures of rayon, vinylon, nylon and acrylic fibers and that such effectiveness can be achieved with use of a surprisingly small amount of binder material. The binder fibers according to the present invention are applicable to dry non-woven fabrics and spun-bonded non-woven fabrics but will provide better results when used in the presence of an appreciable amount of water.

The present invention will be more specifically described in the following examples.

EXAMPLES 1 TO 5; COMPARISONS 1 AND 2

90.2 parts of dimethyl terephthalate, 10.4 parts of 5-dimethyl sodiosulfoisophthalate, 57.4 parts of ethylene glycol, 8.0 parts of dioxethylene glycol and 0.13 part of zinc acetate were mixed together. An ester interchange reaction was carried out on this mixture at temperatures of from 140° C. to 200° C. while removing the methanol produced. To the resultant reaction product were added 0.098 part of trimethylphosphate and 0.146 part of antimony trioxide so as to perform a polymerization reaction at 250° C. in a vacuum of 0.2 mm of Hg. Polyethylene terephthalate polymer was thus obtained which had the intrinsic viscosity of 0.48 as determined on the basis of the viscosity measured with use of an orthochlorophenol solution at 35° C. and which consisted of the copolymer of 7 mole percent of 5-dimethyl sodiosulfoisophthalate and 15 mole percent of dioxyethylene glycol.

Chips each measuring approximately 4 mm×4 mm×2 mm were made from the polymer thus obtained. The chips were dried at a room temperature in a vacuum (of 2 mm of Hg) for 24 hours and were thereafter melted at 280° C. The resultant molten material was extruded through a spinneret containing 720 orifices and the continuous filaments thus produced were wound on a take-up roll at the rate of 600 meters per minute, whereby undrawn filaments each having a titre of 5 denier were obtained. The undrawn filaments were then drawn various draw ratios so as to have various birefringence, whereupon the filaments were cut to the length of 5 mm. The resultant yarns were not adhesive to one another and were remarkably convenient for handling.

The binder fibers prepared in the above described manner were admixed to uncrimped polyethylene terephthalate fibers each having the denier of 0.6 and the length of 5 mm in an amount selected so that the binder fibers accounted for 20 percent by weight of the mixture. The mixture was then dispersed in water in such a manner that the concentration of the fibers was 0.03 percent by weight and was thereafter had made into sheets each with the basis weight of 50 grams per square meter on a square-type sheet paper machine manufactured by Kumagya Riki Kogyo Co., Ltd. The sheets of polyester thus produced were supplied in a wet state to a drier machine (of the rotary K.R.K type, manufactured by Kumagya Riki Kogyo Co., Ltd.) controlled to maintain the temperature of 120° C. and were dried and heat treated in a single step. Tests were then conducted with the resultant sheets of paper to determine the tensile strength in compliance with JIS P 8113 and the tensile elongation in compliance with JIS P 8132, the hand of the sheets being also evaluated in the tests.

For comparison sake, Kuraray Vinylon "VPB 101" (R.T.M. of polyvinyl alcohol fibers each having the denier of 1.3 and the length of 4 mm) and Chisso's "EA" fibers (R.T.M. of sheath-core type conjugate polyolefin fibers consisting of a sheath component of a copolymerized polyethylene and a core component of polypropylene and each having the denier of 3 and the length of 5 mm) were selected as examples of the commercially available binder fibers. Tests were conducted with these specimens under the same conditions as used in Examples 1 to 5. The results of these tests as well as the results of the tests conducted with the fibers prepared in Examples 1 to 5 are shown in Table 1.

From Table 1 it will be seen that the binder fibers produced in accordance with the present invention are softer in the hand and more effective as binding materials than the known binder fibers and that the hand becomes slightly harder and the effectiveness as the binding materials become deteriorated as the birefringence exceeds 0.10.

TABLE 1

| | Kinds of Binder Fibers | Draw Ratio | Bi-refringence | Tenacity (kg/15 mm) | Elongation (%) | Hand |
|---|---|---|---|---|---|---|
| Example 1 | Polyester Copolymer of Invention | (Not drawn) | 0.004 | 2.9 | 14.2 | Soft |
| Example 2 | Polyester Copolymer of Invention | 1.5 | 0.014 | 2.0 | 12.1 | Soft |
| Example 3 | Polyester Copolymer of Invention | 2.0 | 0.06 | 1.3 | 8.3 | Soft |
| Example 4 | Polyester Copolymer of Invention | 2.3 | 0.09 | 0.8 | 5.4 | Soft |
| Example 5 | Polyester Copolymer of Invention | 2.6 | 0.11 | 0.4 | 2.5 | Slightly hard |
| Comparison 1 | Kuraray Vinylon "VPB101" | — | — | 0.4 | 1.7 | Hard |
| Comparison 2 | Chisso's "EA" fibers | — | — | 0.3 | 2.8 | Hard |

EXAMPLE 6

87.3 parts of dimethyl terephthalate, 14.8 parts of 5-dimethyl sodiosulfoisophthalate, 57.4 parts of ethylene glycol, 14.6 parts of tetraethylene glycol and 0.13 part of zinc acetate were mixed together. An ester interchange reaction was carried out on this mixture at temperatures of from 140° C. to 200° C. while removing the methanol produced. To the resultant reaction product were added 0.098 part of trimethylphosphate and 0.146 part of antimony trioxide so as to perform a polymerization reaction. Polyethylene terephthalate polymer was thus obtained which had the intrinsic viscosity of 0.42 as determined on the basis of the viscosity measured with use of an orthochlorophenol solution at 35° C. and which consisted of 10 mole percent of copolymerized 5-dimethyl sodiosulfoisophthalate and 15 mole percent of copolymerized tetra oxyethylene glycol.

Chips were made from the polymer thus obtained and were dried as in Example 1. The dried chips were melted at 255° C. and the resultant molten material was extruded through a spinneret having 720 orifices. The continuous filaments thus produced were wound on a take-up roll at the rate of 600 meters per minute, whereby undrawn filaments each having the denier of 5 were obtained. The undrawn filaments were then cut to the length of 5 millimeters without being drawn. The resultant filaments had the birefringence of 0.003 and were not adhesive to one another providing remarkable convenience for handling. The binder fibers prepared in the above described manner were admixed to uncrimped polyethylene terephthalate fibers each having the denier of 0.6 and the length of 5 mm in an amount selected so that the binder fibers accounted for 20 percent by weight of the mixture. A sheet of paper was made from the mixture under the same conditions as in Example 1 except that the sheets of paper prepared was dried and heat processed at 100° C. The tests conducted with the resultant sheet of paper showed that the paper had the tenacity of 2.5 kgs/15 mm and the elongation of 11.3% and excellent effectiveness as a binding material.

Furthermore, the sheet of paper has a remarkably soft hand.

Comparison 4, the fibers in handling tend to adhere to one another and exhibit deteriorated thermal stability.

TABLE 2

| | Components of Polymer | | | | Properties of Polymer | | | | Properties of Paper | |
|---|---|---|---|---|---|---|---|---|---|---|
| | Acid Component (Mole %) | | Glycol Component (Mole %) | | | | | | | |
| | DMT(1) | SI(2) | EG(3) | DEG(4) | Intrinsic(5) Viscosity (dl/g) | Thermal(6) Stability | Adhesiveness of Wound Undrawn Yarns | Birefringence of Undrawn Yarns | Tenacity (kg/15 mm) | Elongation (%) |
| Comparison 3 | 93 | 7 | 96 | 4 | 0.50 | A | Nil | 0.005 | 0.4 | 3.3 |
| Example 7 | 93 | 7 | 94 | 6 | 0.49 | A | Nil | 0.005 | 0.9 | 6.7 |
| Example 8 | 93 | 7 | 82 | 18 | 0.48 | B | Slight | 0.004 | 2.8 | 13.6 |
| Comparison 4 | 93 | 7 | 75 | 23 | 0.46 | C | Notable | 0.004 | 2.9 | 14.8 |

Notes:
(1)Dimethyl terephthalate
(2)Dimethyl 5-sodiosulfoisophthalate
(3)Ethylene glycol
(4)Dioxyethylene glycol
(5)Values measured in orthochlorophenol at 35° C.
(6)Change in hue when a polymer is dried at 70° C. for 5 hours (goldening), wherein
A: Little change occurs.
B: Slight change occurs.
C: Notable change occurs.

EXAMPLES 7 AND 8, COMPARISONS 3 AND 4

A polymer was prepared under the same condition as in Example 1 except that the proportion of the dioxyethylene glycol used was this time changed. The fibers produced from the polymer thus prepared were tested also as in Example 1, the results of the tests being shown in Table 2. The binder fibers used in these tests were left undrawn and had the length of 5 millimeters. Table 2 also shows the birefringences of the binder fibers tested.

As will be seen from Table 2, satisfactory results are achieved when the proportion of the copolymerized dioxyethylene glycol is more than 5 mole percent and less than 20 mole percent as in Examples 7 and 8 and that, when the proportion of the copolymerized dioxyethylene glycol is less than 5 mole percent as in Comparison 3, the binder fibers fails to provide acceptable binding performance. It will be further seen from Table 2 that, when the proportion of the copolymerized dioxyethylene becomes more than 20 mole percent as in

What is claimed is:

1. Polyester binder fibers consisting of a copolymerized polyester comprising at least one dicarboxylic acid and/or an esterforming derivative thereof, a glycol and an ester-forming sulfonic acid alkali metal salt composition, wherein the total glycol component contained in said polyester contains from 5 mole percent to 20 mole percent of a composition represented by the formula $H—OCH_2CH_2)_nOH$, wherein n is an integer of from 2 to 13 and wherein the binder fibers have a birefringence of less than 0.10.

2. Polyester binder fibers as set forth in claim 1, wherein said dicarboxylic acid and/or an esterforming derivative thereof is terephthalic acid or an esterforming derivative thereof.

3. Polyester binder fibers as set forth in claim 1, wherein said esterforming sulfonic acid alkali metal salt composition is 5-sodiosulfoisophthalate.

4. Polyester binder fibers as set forth in claim 1, wherein the number n in said formula $H—OCH_2CH_2)_nOH$ is an integer of from 2 to 5.

* * * * *